US007746003B2

(12) United States Patent
Verfuerth et al.

(10) Patent No.: US 7,746,003 B2
(45) Date of Patent: Jun. 29, 2010

(54) TRANSFORMER WIRING METHOD AND APPARATUS FOR FLUORESCENT LIGHTING

(75) Inventors: Neal R. Verfuerth, Plymouth, WI (US); Anthony J. Bartol, Plymouth, WI (US); Ronald E. Ernst, Waldo, WI (US); Kenneth J. Wetenkamp, Plymouth, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 213 days.

(21) Appl. No.: 12/011,771

(22) Filed: Jan. 29, 2008

(65) Prior Publication Data

US 2009/0189535 A1 Jul. 30, 2009

(51) Int. Cl.
*H05B 41/16* (2006.01)

(52) U.S. Cl. ..... 315/276; 315/254; 315/282; 315/288

(58) Field of Classification Search ..... 315/246, 315/254, 276, 282, 288, 291
See application file for complete search history.

(56) References Cited

U.S. PATENT DOCUMENTS

| | | | | |
|---|---|---|---|---|
| 2,403,240 | A | 7/1946 | Sawin | |
| 2,636,977 | A | 4/1953 | Foster | |
| 3,337,035 | A | 8/1967 | Pennybacker | |
| 4,051,547 | A * | 9/1977 | Wood | 361/160 |
| 4,144,462 | A | 3/1979 | Sieron et al. | |
| 4,207,497 | A * | 6/1980 | Capewell et al. | 315/96 |
| 4,387,417 | A | 6/1983 | Plemmons et al. | |
| 5,173,643 | A * | 12/1992 | Sullivan et al. | 315/276 |
| 5,192,897 | A * | 3/1993 | Vossough et al. | 315/308 |
| 5,371,661 | A | 12/1994 | Simpson | |
| 5,959,412 | A * | 9/1999 | Ushijima | 315/276 |
| D447,266 | S | 8/2001 | Verfuerth | |
| D463,059 | S | 9/2002 | Verfuerth | |
| 6,467,933 | B2 | 10/2002 | Baar | |
| D479,826 | S | 9/2003 | Verfuerth et al. | |
| 6,644,836 | B1 | 11/2003 | Adams | |
| D483,332 | S | 12/2003 | Verfuerth | |
| 6,746,274 | B1 | 6/2004 | Verfuerth | |
| 6,758,580 | B1 | 7/2004 | Verfuerth | |
| 6,858,396 | B2 | 2/2005 | Dix | |
| 6,979,097 | B2 | 12/2005 | Elam et al. | |
| 7,378,802 | B2 * | 5/2008 | Ichikawa et al. | 315/219 |
| 2002/0062180 | A1 * | 5/2002 | Enberg | 700/286 |
| 2002/0172049 | A1 | 11/2002 | Yueh | |

(Continued)

OTHER PUBLICATIONS

Product Description Page for 480V:277V ATX, Step Down Autotransformer for Lighting Applications, Thomas Research Products, Huntley, IL, Nov. 30, 2007, 1 page, www.thomasresearchproducts.com.

(Continued)

*Primary Examiner*—Douglas W Owens
*Assistant Examiner*—Tung X Le
(74) *Attorney, Agent, or Firm*—Foley & Lardner LLP

(57) ABSTRACT

A transformer wiring method and apparatus for fluorescent lighting are described. The fluorescent lighting apparatus includes a transformer and a ballast. An installer is easily able to balance the system load because each fluorescent lighting apparatus includes its own transformer and may be connected directly to a facility's three phase power distribution while still operating at rated voltages. Moreover, the ballast is protected from surges and stray voltages thereby reducing the frequency of ballast failures.

25 Claims, 3 Drawing Sheets

U.S. PATENT DOCUMENTS

| | | | | |
|---|---|---|---|---|
| 2003/0179577 | A1 | 9/2003 | Marsh | |
| 2004/0076001 | A1 | 4/2004 | Lutes | |
| 2005/0018371 | A1* | 1/2005 | Mladenik et al. | 361/78 |
| 2005/0023988 | A1* | 2/2005 | Komatsu et al. | 315/224 |
| 2005/0035729 | A1* | 2/2005 | Lev et al. | 315/291 |
| 2008/0007943 | A1 | 1/2008 | Verfuerth et al. | |
| 2008/0007944 | A1 | 1/2008 | Verfuerth et al. | |

OTHER PUBLICATIONS

Product Description Page For GETR480V/277-375W Step Down Autotransformer, GE Consumer & Industrial: Lighting, Oct. 2008, 2 pages, www.gelighting.com.

U.S. Appl. No. 11/242,620, filed Oct. 3, 2005, Verfuerth, Neal R.

* cited by examiner

TRANSFORMER WIRING METHOD AND APPARATUS FOR FLUORESCENT LIGHTING

FIELD

The subject of the disclosure relates generally to fluorescent light fixtures, and more particularly to fluorescent light fixtures powered by industrial high voltage power sources.

BACKGROUND

The following background is provided simply as an aid in understanding the disclosed apparatus and method and is not admitted to describe or constitute prior art.

In large commercial or industrial buildings (e.g. facilities, plants, etc.), electricity costs for lighting can be more than half of the total energy budget. Consequently, considerable economic benefits can be obtained through more efficient lighting techniques. Lighting technologies improve in performance and efficiency over time such that many existing commercial buildings will eventually consider some form of lighting retrofit or redeployment. In many cases, fluorescent lighting is the most desirable technology from the standpoint of the quality and quantity of light generated per unit cost.

Existing commercial or industrial buildings vary widely in age, construction, and intended use; hence, the electric power sources used in any given plant may vary. Typically, lighting is provided through high intensity discharge lighting that runs on single phase 120 Volts-Alternating Current (VAC), 208 VAC, 240 VAC, 277 VAC, or 480 VAC. However, three phase power, often 480 VAC, is what is most common at many large industrial, commercial, or manufacturing sites in the U.S.

Fluorescent lamps provide one of the most efficient forms of lighting. The fluorescent lamps in a fluorescent light fixture are powered by a ballast that converts line voltages to a high frequency, high voltage output. The type of ballast in a particular fixture determines, for example, the power consumption and optimal type of lamp to be used in the fixture.

Ballasts for fluorescent light fixtures are typically designed to receive single phase electrical power at a voltage level of 120 VAC or 277 VAC. Where a facility has a 480/277 Wye setup, ballasts can be run directly from a leg of the Wye. However, in this case, a dedicated 277 V circuit must be wired from the transformer throughout the facility. Additionally, the dedicated circuit must be load balanced on the Wye. Alternatively, a transformer can be used to adjust a plant 480 VAC single phase voltage to the 277 VAC voltage suitable for a typical ballast. However, creating 277 VAC single phase voltage for a large plant involves expensive transformers, wiring a dedicated circuit, and careful load balancing.

For example, in a grounded 480V Wye system, a plant would typically create a dedicated single phase 277V circuit for lighting. A centralized 480/277 step-down transformer, the primary of which is wired to two legs of the Wye, is typically installed at the main distribution panel. The lighting fixtures in the plant are then wired to this 277V circuit. Three main challenges are introduced using this method. First, there is considerable energy loss at the large centralized transformer and line loss over the wiring. Second, a dedicated circuit is expensive to wire throughout a plant. Third, the load on the Wye circuit must be balanced. Lights, in aggregate, draw a considerable amount of power; therefore, good electrical design practice requires that the lighting load be equally apportioned amongst the three legs of the Wye. Optimizing balancing requires careful load planning, which is difficult in a plant, or often requires the expense of additional transformers. Hence, a need exists for efficient methods of directly powering fluorescent lamps from a three phase power source.

Additionally, the ballast is typically hard wired inside the fixture, making ballast failures much more costly to repair than, for example, a lamp failure; hence, there is a need for techniques that reduce ballast failures.

Accordingly, it would be desirable to provide a transformer wiring method and apparatus for fluorescent lighting that provides any one or more of these advantageous features.

SUMMARY

One embodiment of the disclosure relates to fluorescent lighting apparatus, that includes a transformer having a primary winding with a first end connectable to a first line input and a second end connectable to a second line input, and a secondary winding having a first end and a second end. A ballast is also provided having a common ballast line input connected to the first end of the secondary winding, and a hot ballast line input connected to the second end of the secondary winding. A jumper is connected to the second end of the primary winding and the second end of the secondary winding so that second line input and the second end of the primary winding and the second end of the secondary winding and the hot ballast input line have electrical continuity.

Another embodiment of the disclosure a fluorescent lighting apparatus, that includes an autotransformer having a primary winding with a first end connectable to a first line input and a second end connectable to a second line input, and a tap. A ballast is also provided having a common ballast line input connected to the tap, and a hot ballast line input connected to the second end of the secondary winding. The second line input and the second end of the autotransformer and the hot ballast line input have electrical continuity.

Another embodiment of the disclosure relates to a method of wiring a fluorescent lighting apparatus having a transformer and a ballast, an includes the steps of connecting a primary winding of the transformer to a first line input and a second line input, and connecting a secondary winding of the transformer to a common ballast line input and a hot ballast line input of the ballast, and connecting one end of the primary winding to one end of the secondary winding so that second line input and the one end of the primary winding and the one end of the secondary winding and the hot ballast input line have electrical continuity, and connecting a ballast ground of the ballast to a ground or a common.

Another embodiment of the disclosure relates to a method of wiring a fluorescent lighting apparatus having an autotransformer and a ballast, and includes the steps of connecting a winding of the autotransformer to a first line input and a second line input, connecting a tap of the autotransformer to a common ballast line input of the ballast, and connecting one end of the winding to a hot ballast line input of the ballast so that the second line input and the one end of the winding and the hot ballast line input have electrical continuity, and connecting a ballast ground of the ballast to a ground or a common.

DETAILED DESCRIPTION

A transformer wiring method and apparatus for fluorescent lighting are described. In the following description, for the purposes of explanation, numerous specific details are set forth to provide a thorough understanding of exemplary embodiments. It will be evident, however, to one skilled in the art that alternative embodiments may be practiced without these specific details. Well known structures and devices are shown in block diagram form to facilitate description of the exemplary embodiments. In addition, the terms "connected to" and "wired to" are intended to be broad terms indicating an interconnection between components that may be directly connected with one another, or indirectly connected to one another via other components.

Figure 1:
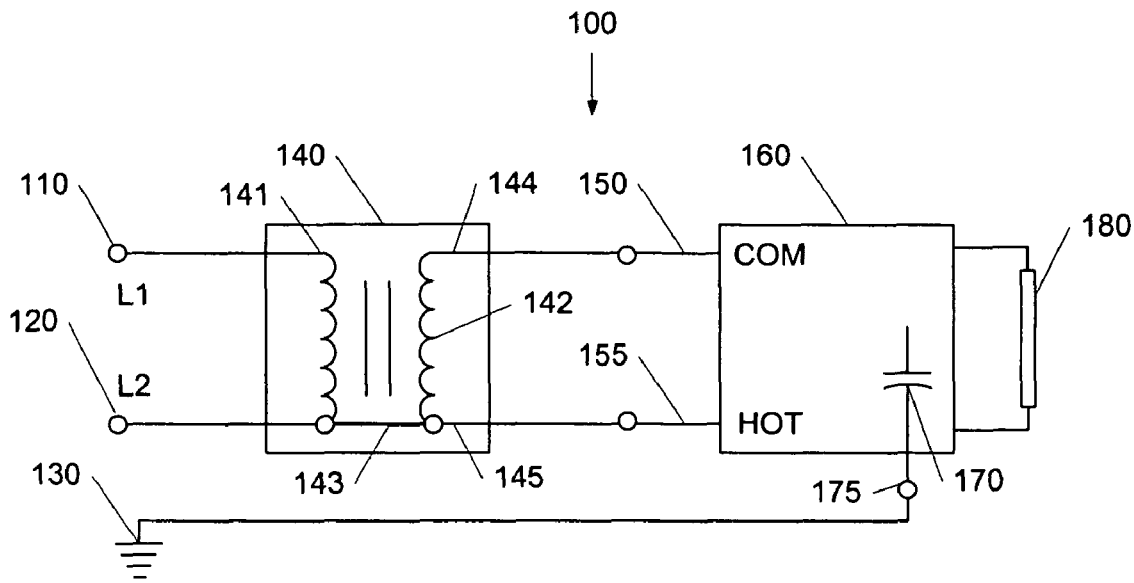
FIG. 1 depicts a schematic representation of a fluorescent lighting apparatus, according to an exemplary embodiment.

Referring to FIG. 1, a fluorescent lighting apparatus (e.g. fixture, etc.) 100 is shown schematically in accordance with an exemplary embodiment. Apparatus 100 includes other suitable components such as a frame, reflectors, raceways, bulb holders, etc. (not shown). Fluorescent lighting apparatus 100 includes a transformer 140 and a ballast 160. The transformer is intended to be a "dedicated" transformer for use with a particular fixture and may be provided with the ballast as a single unit on the fixture (e.g. pre-wired to one another for rapid and convenient installation on site, etc.), or the transformer may be provided separately for externally wiring to the ballast and may be secured to the fixture (e.g. for use in retro-fit applications with existing lighting fixtures, etc.). According to other embodiments, one transformer may be used with several (e.g. adjacent or grouped) fixtures. A primary winding 141 of transformer 140 is connected to a first line input 110 and a second line input 120. A secondary winding 142 of transformer 140 includes a first transformer output 144 and a second transformer output 145. The first transformer output 144 is wired to a common ballast line input 150 and the second transformer output 145 is wired to a hot ballast line input 155. The common ballast line input 150 is the common terminal of a ballast which is usually marked white. The hot ballast line input 155 is the hot terminal of a ballast which is usually marked black. The common ballast line input 150 and the hot ballast line input 155 power the ballast 160. Hence, the common ballast line input 150 and the hot ballast line input 155 are wired the "opposite" of a standard installation.

One end of the primary winding 141 of transformer 140 is tied to the second transformer output 145 of the secondary winding 142 of transformer 140 by a jumper 143. Hence, the second line input 120, one end of the primary winding 141, the jumper 143, one end of the secondary winding 142, the second transformer output 145, and the hot ballast line input 155 have electrical continuity. Notably, the second line input 120, one end of the primary winding 141, the jumper 143, one end of the secondary winding 142, the second transformer output 145, and the hot ballast line input 155 are not grounded, nor are they wired as a neutral.

Ballast 160 powers one or more fluorescent bulb(s) 180. Ballast 160 typically includes an isolation capacitor 170. The isolation capacitor 170 is rated at approximately 250 V. The isolation capacitor is typically integrated into the ballast. However, the isolation capacitor can be separate from the ballast. In some plants with grounding problems, it may be desirable to increase the isolation capacitance by supplementing the integrated isolation capacitor with an external capacitor. Additional isolation capacitance protects the ballast circuit from stray voltages and surges. The isolation capacitor 170 is connected to a ballast ground 175. The ballast ground 175 is wired to a plant ground 130.

Alternatively, a varistor circuit can be used instead of an isolation capacitor. In particular, a metal oxide varistor (MOV) can be used. Many manufacturers use MOVs in ballasts. Typically, the varistor has a rating of about 250V. Likewise, external varistors can be used to shunt stray voltages.

According to a preferred embodiment, the ballast is an electronic ballast; for example, the Ultra-Max Electronic High Efficiency Multi-Volt Instant Start Ballast commercially available from General Electric Corporation. The Ultra-Max ballast has an integrated isolation capacitor. Magnetic ballasts can also be used. Alternatively, any other type of ballast can be used such as a ballast for a halogen lamp or a high-intensity discharge lamp.

In alternative embodiments, a plurality of bulbs can be used. Likewise, a plurality of ballasts can be used. The transformer is a toroidal transformer. However, other transformers may be used. Standard ferrite core transformers can be used as long as one end of the primary and one end of the secondary are tied together. The primary and secondary can be tied together at different points to produce the desired voltages as well known in the art. An autotransformer can be used in a step-down configuration where the ends of the autotransformer represent the primary winding; and one end of the autotransformer and the tap represent the secondary winding.

Figure 2:
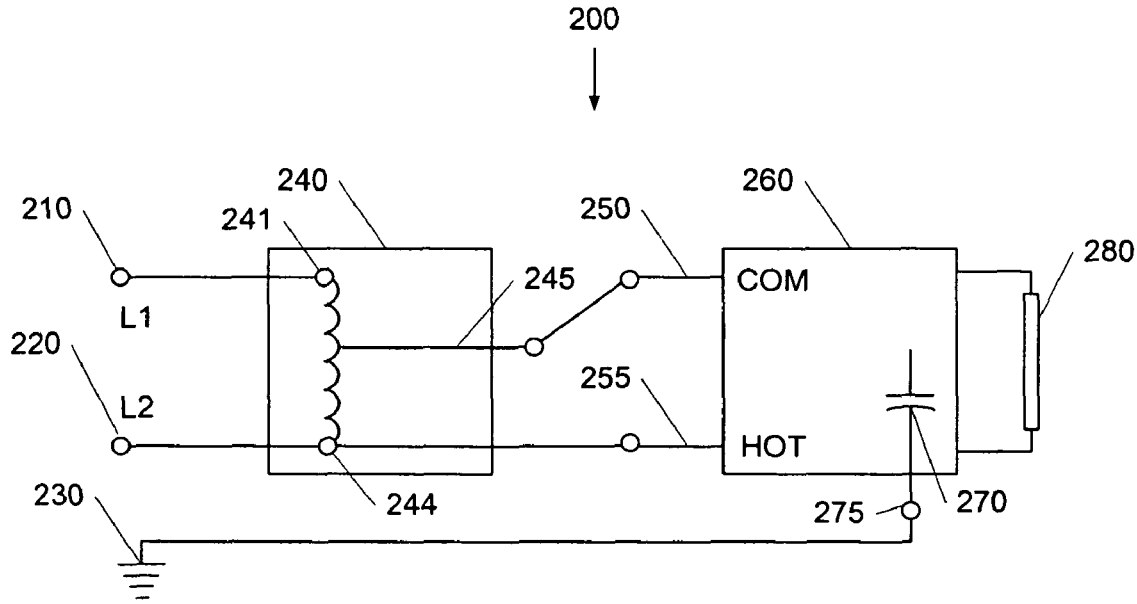
FIG. 2 depicts a schematic representation of a fluorescent lighting apparatus using an autotransformer, according to an exemplary embodiment.

Referring to FIG. 2, a fluorescent lighting apparatus using an autotransformer 200 is shown in accordance with an exemplary embodiment. The fluorescent lighting apparatus using an autotransformer 200 includes an autotransformer 240 and a ballast 260. A first end 241 of autotransformer 200 and a second end 244 of autotransformer 200 represent a primary winding. The first end 241 is connected to a first line input 210; and the second end 244 is connected to a second line input 220. A tap 245 of autotransformer 200 is wired to a common ballast line input 250; and the second end 244 of autotransformer 200 is wired to a hot ballast line input 255. The common ballast line input 250 is the common terminal of a ballast which is usually marked white. The hot ballast line input 255 is the hot terminal of a ballast which is usually marked black. The common ballast line input 250 and the hot ballast line input 255 power the ballast 260. Hence, the common ballast line input 250 and the hot ballast line input 255 are wired the "opposite" of a standard installation.

The second line input 220, the second end 244 of autotransformer 200, and the hot ballast line input 255 have electrical continuity. Notably, the second line input 220, the second end 244 of autotransformer 200, and the hot ballast line input 255 are not grounded, nor are they wired as a neutral.

Ballast 260 powers fluorescent bulb 280. Ballast 260 typically includes an isolation capacitor 270. The isolation capacitor 270 is rated at 250 V. Alternatively, a varistor circuit can be used in lieu of the isolation capacitor. The isolation capacitor 270 is connected to a ballast ground 275. The ballast ground 275 is wired to a plant ground 230.

Three phase power is distributed in two general ways: a Wye configuration or a Delta configuration. The source and load configurations can be mixed. For instance, a Delta source can be used to drive a Wye load. In the United States, plants typically have Delta-Wye configurations at the distribution transformer where the plant connects to the utility grid. The source lines from the power plant are tied to the primaries of the distribution transformer in a Wye; and the load from the plant is tied to the secondaries of the distribution transformer in a Wye.

Figure 3:
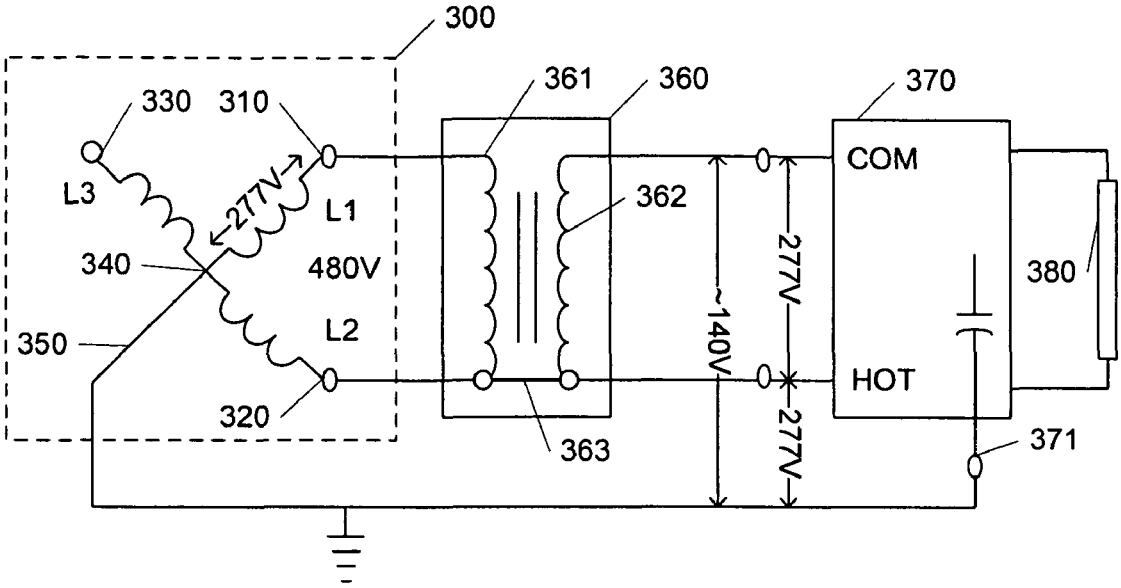
FIG. 3 depicts a schematic representation of a fluorescent lighting apparatus wired to a Wye circuit, according to an exemplary embodiment.

In an exemplary embodiment, the line inputs to the primary of the fluorescent lighting apparatus transformer are typically wired to a 480 VAC Wye load system as shown in FIG. 3. In this example, the plant is wired as a Wye load 300. The Wye load 300 has a first leg 310, a second leg 320, and a third leg 330. These legs are typically the secondary windings of a distribution transformer. Each leg of the Wye has 277 V across it. One end of the first leg 310, the second leg 320, and the third leg 330 are tied together at a tie terminal 340. The tie terminal 340 is wired to a ground 350.

The first leg 310 and the second leg 320 are wired to a primary winding 361 of a transformer 360. A secondary winding 362 of transformer 360 drives a ballast 370. The transformer 360 is typically a 480/277 step-down transformer. The primary winding 361 and the secondary winding 362 of transformer 360 are tied together at one end by a jumper 363. The ballast 370 drives a fluorescent bulb 380. A ballast ground 371 of ballast 370 is wired to ground 350.

Figure 4:
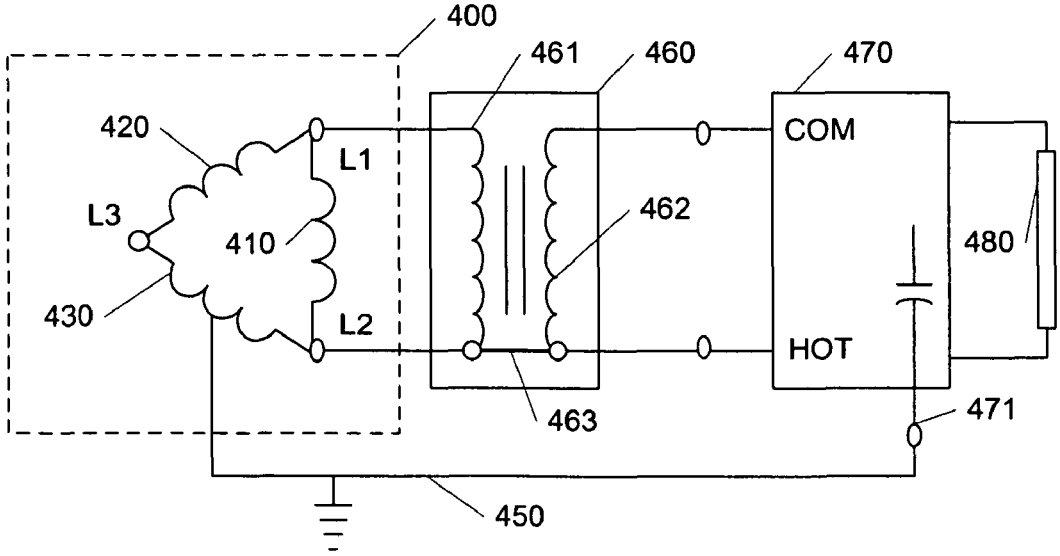
FIG. 4 depicts a schematic representation of a fluorescent lighting apparatus wired to a Delta circuit, according to an exemplary embodiment.

Alternatively, the line inputs to the primary of the transformer are powered by a Delta system as shown in FIG. 4. In this example, the plant is wired as a center grounded Delta load 400. The Delta load 400 has a first leg 410, a second leg 420, and a third leg 430. These legs are typically the secondary windings of a distribution transformer. One end of the first leg 410 is tied to one end of the second leg 420. The other end of the second leg 420 is tied to one end of the third leg 430. Finally, the remaining ends of the first leg 410 and third leg 430 are tied together.

The ends of the first leg 410 are wired to a primary winding 461 of a transformer 460. A secondary winding 462 of transformer 460 drives a ballast 470. The primary winding 461 and the secondary winding 462 of transformer 460 are tied together at one end by a jumper 463. The ballast 470 drives a fluorescent bulb 480. A ballast ground 471 of ballast 470 is wired to a common 450.

The Wye system is preferred because it is most common and because ballasts are typically made to run on 480/277 systems. Other methods of supply wiring can be used such as un-grounded Delta, corner-grounded Delta, or an ungrounded Wye. As is well known in the art, a plant typically has various electrical distribution equipment between the load at its distribution transformer and the line wiring in the plant such as fuses, throws, breakers, and isolation transformers.

Advantageously, an installer is easily able to balance the system load because each fluorescent lighting apparatus includes its own transformer and may be connected directly to the three phase power distribution. Hence, the expense of a large industrial transformer for a dedicated single phase circuit is eliminated. Likewise, the expense of having distribution wiring for a specialized purpose is eliminated. Moreover, the energy loss from a large centralized step down transformer is eliminated; and line-loss from distribution wiring is reduced.

In a typical plant lighting system, a 480 VAC three phase source is converted into 277 VAC single phase which is then used to power a ballast. The ballast is powered by the single phase input where, for example, one of the line inputs to the ballast is tied to a ground or neutral which is subsequently tied to the ballast ground. However, in the exemplary embodiment, by switching the hot and common inputs to the ballast, and by not tying either of the line inputs to the ballast ground, a unique, advantageous electrical situation occurs. In a standard installation, where the common and hot are wired in the standard manner, the ballast would often be destroyed by wiring directly to two lines (i.e. two hot legs of the Wye). In this situation, the isolation capacitor sees 277V which is above its rating; therefore, the capacitor or varistor may be damaged along with the ballast. By switching the hot and common inputs to the ballast, the voltage from the common terminal of the ballast to the ballast ground sees a much lower peak voltage (typically about 140V) than would be expected in a typical 480/277 system.

Referring again to FIG. 1, the operation of the fluorescent lighting apparatus 100 driven by a three phase 480V Wye system is described. The first line input 110 is driven by a 277V 60 Hz line voltage. The second line input 120 is driven by a 277V 60 Hz line voltage that is 120 degrees out of phase relative to the first line input 110. Hence, voltage across the first line input 110 and the second line input 120 is 480 VAC. The input line power can be obtained from a utility, a generator, or any other type of power supply known to those of skill in the art.

In this example, the transformer 140 is a 480/277 step-down transformer. Hence, the voltage observed between the common ballast line input 150 and the hot ballast line input 155 is 277 VAC. The voltage observed between the hot ballast line input 155 and the ballast ground 175 is 277 VAC. However, the voltage observed between the common ballast line input 150 and the ballast ground 175 is approximately 140 VAC which is lower than the isolation capacitor rating of 250V. The actual voltage observed at the ballast relative to ground will vary from plant to plant depending on the quality of the grounding at the plant which determines the capacitive load in the plant grid.

The ballast 160 then converts the 277 V, 60 Hz input into a high voltage, high frequency output (e.g. 800 V, 42 kHz) that excites the fluorescent bulb 180. Likewise, other source voltages and step-down transformers can be used. Advantageously, using the present apparatuses and methods, a standard ballast can be wired directly to three phase wiring while still operating within standard rated voltages without being destroyed. Moreover, the ballast is protected from surges, stray voltages, and brown-outs through its isolation and nominal operating voltage, thereby reducing the frequency of ballast failures.

Referring again to FIG. 2, the operation of the fluorescent lighting apparatus using an autotransformer 200 driven by a three phase 480V Wye system is described. The first line input 210 is driven by a 277V 60 Hz line voltage. The second line input 220 is driven by a 277V 60 Hz line voltage that is 120 degrees out of phase relative to the first line input 210. Hence, voltage across the first line input 210 and the second line input 220 is 480 VAC. The input line power can be obtained from a utility, a generator, or any other type of power supply known to those of skill in the art.

In this example, the autotransformer 240 is a 480/277 step-down toroidal autotransformer. Hence, the voltage observed between the common ballast line input 250 and the hot ballast line input 255 is 277 VAC. The voltage observed between the hot ballast line input 255 and the ballast ground 275 is 277 VAC. However, the voltage observed between the common ballast line input 250 and the ballast ground 275 is approximately 140 VAC which is lower than the isolation capacitor rating of 250V. In experiments, the observed voltage between a common ballast line input and a ballast ground was approximately 142V. The actual voltage observed at the ballast relative to ground will vary from plant to plant depending on the quality of the grounding at the plant which determines the capacitive load in the plant grid.

The ballast 260 then converts the 277 V, 60 Hz input into a high voltage, high frequency output (e.g. 800 V, 42 kHz) that excites the fluorescent bulb 280. Likewise, other source voltages and step-down autotransformers (or equivalents) can be used. Advantageously, using the present apparatuses and methods, a standard ballast can be wired directly to three phase wiring while still operating within standard rated voltages without being damaged or destroyed. Moreover, the ballast is protected from surges, stray voltages, and brownouts through its isolation and nominal operating voltage, thereby reducing the frequency of ballast failures.

Figure 5:
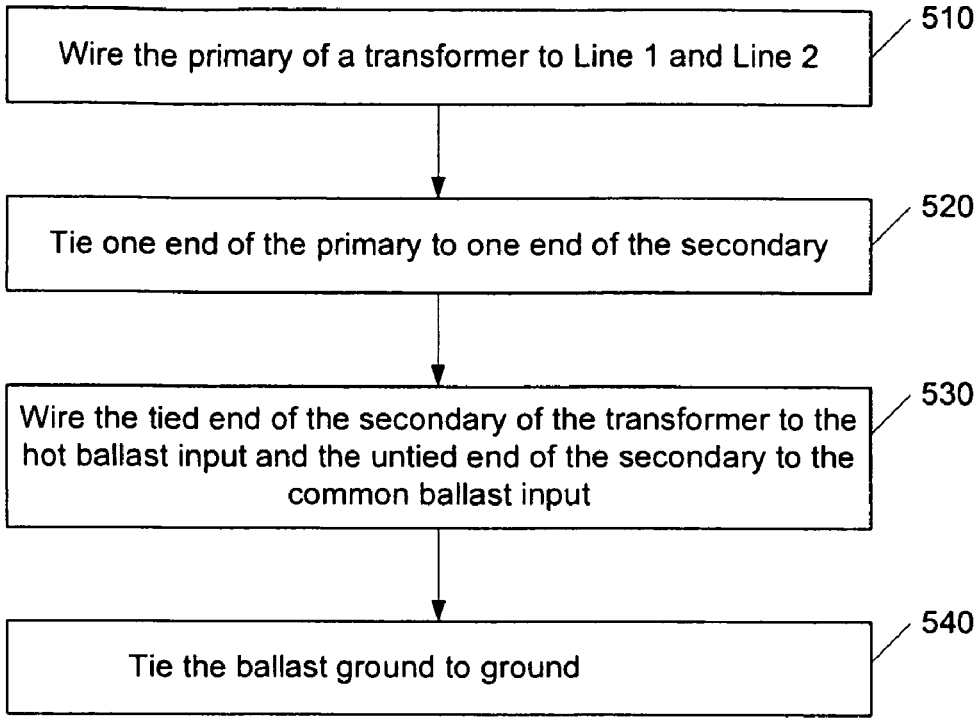
FIG. 5 depicts a schematic representation of a flowchart of a fluorescent lighting wiring method, according to an exemplary embodiment.

Referring to FIG. 5, a fluorescent lighting apparatus wiring flowchart is shown in accordance with an exemplary embodiment. In a source operation 510, an installer wires a primary winding of a transformer to a first line voltage and a second line voltage. In a continuity operation 520, the installer ties one end of the primary winding to one end of a secondary winding. In a ballast operation 530, an installer wires the tied end of the secondary of the transformer to a hot ballast input and the untied end of the secondary to a common ballast input. In a ballast grounding operation 540, the installer ties a ballast ground to a plant ground or a ground.

Figure 6:
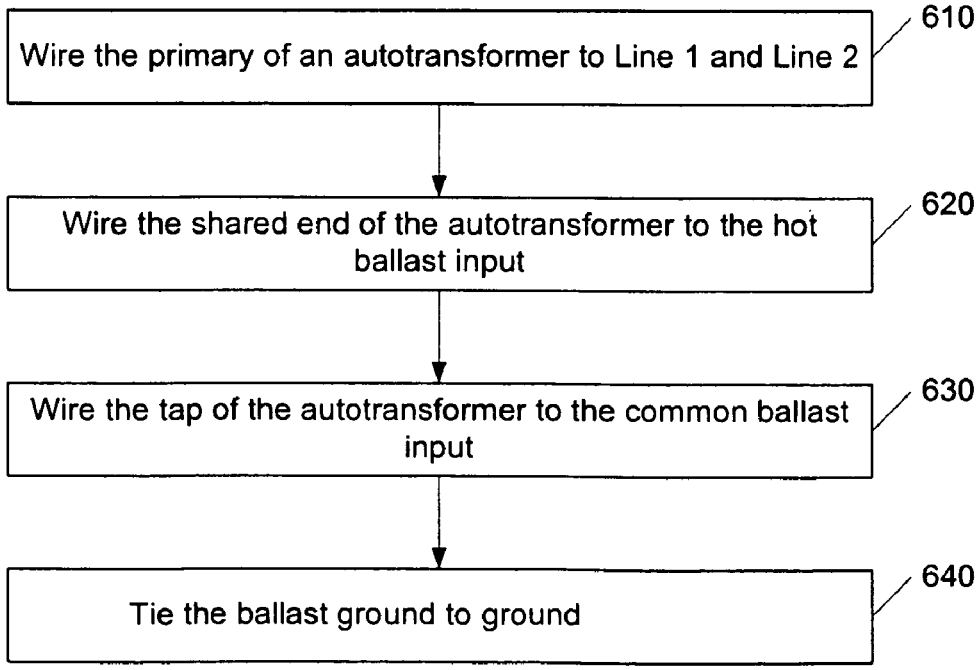
FIG. 6 depicts a schematic representation of a flowchart of a fluorescent lighting wiring method using an autotransformer, according to an exemplary embodiment.

Referring to FIG. 6, a fluorescent lighting apparatus using an autotransformer wiring flowchart is shown in accordance with an exemplary embodiment. In a source operation 610, an installer wires a primary winding of an autotransformer to a first line voltage and a second line voltage. In a continuity operation 620, the installer wires a shared end of the primary winding of the autotransformer to a hot line input of a ballast. In a ballast operation 630, an installer wires a tap from the autotransformer to a common line input of the ballast. In a ballast grounding operation 640, the installer ties a ballast ground to a plant ground or a ground.

The foregoing description of exemplary embodiments of the invention have been presented for purposes of illustration and of description. It is not intended to be exhaustive or to limit the invention to the precise form disclosed, and modifications and variations are possible in light of the above teachings or may be acquired from practice of the invention. For example, the described exemplary embodiments focused on an implementation designed to operate using an 480Y/277 system. The present invention, however, is not limited to a particular format. Those skilled in the art will recognize that the system and methods of the present invention may be advantageously operated on different platforms using different formats including but not limited to 240V and 600V systems. The sizes and ratings of the components (e.g. the capacitors or varistors) may have to be altered according to the type and voltage of the power system. Additionally, the order of execution of the functions may be changed without deviating from the spirit of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A fluorescent lighting apparatus, comprising:

a step-down transformer supported on the fluorescent lighting apparatus, the transformer having a primary winding with a first end connectible to a first line input and a second end connectible to a second line input, and a secondary winding having a first end and a second end;

a ballast having a common ballast line input connected to the first end of the secondary winding, and a hot ballast line input connected to the second end of the secondary winding; and a jumper connected to the second end of the primary winding and the second end of the secondary winding so that second line input and the second end of the primary winding and the second end of the secondary winding and the hot ballast input line have electrical continuity.

2. The apparatus of claim 1 wherein the apparatus is installed in a facility, and the ballast further comprises a ballast ground connectable to a facility ground and an isolation capacitor coupled to the ballast ground.

3. The apparatus of claim 2 wherein the isolation capacitor is external to the ballast.

4. The apparatus of claim 3 wherein the step-down transformer is a toroidal 480V to 277V step-down transformer.

5. The apparatus of claim 4 wherein a voltage between the common ballast input line and the ballast ground is approximately 140VAC.

6. The apparatus of claim 2 wherein the first line input is connected to a first end of a first leg of a Wye load, and the second input line is connected to a first end of a second leg of the Wye load, and a second end of the first leg and a second end of the second leg are connected together at a terminal, and the terminal is connected to the facility ground.

7. The apparatus of claim 1 wherein the step-down transformer and the ballast are provided as a single unit mounted on a single fluorescent lighting fixture.

8. The apparatus of claim 1 wherein the step-down transformer is a separate component externally connectable to the ballast of a fluorescent lighting fixture.

9. The apparatus of claim 1 further comprising at least one bulb powered by the ballast.

10. The apparatus of claim 1 wherein the first line input is connected to a first end of a first leg of a Delta load, and the second input line is connected to a second end of the first leg of the Delta load.

11. The apparatus of claim 10 wherein the ballast comprises a ballast ground connectable to a common.

12. The apparatus of claim 1 wherein the second line input and the second end of the primary winding and the second end of the secondary winding and the hot ballast input line are not grounded and are not wired as a neutral.

13. The apparatus of claim 1 wherein the apparatus is installed in a facility, and the ballast further comprises a ballast ground connectable to a facility ground and a varistor coupled to the ballast ground.

14. The apparatus of claim 13 wherein the varistor is external to the ballast.

15. A fluorescent lighting apparatus, comprising:

a 480V to 277V step-down autotransformer supported on the fluorescent lighting apparatus, the autotransformer having a primary winding with a first end connectable to a first line input and a second end connectable to a second line input, and a tap;

a ballast having a common ballast line input connected to the tap, and a hot ballast line input connected to the second end of the secondary winding;

a jumper electrically connected to the second end of the primary winding and the hot ballast line input, so that the second line input and the second end of the autotransformer and the hot ballast line input have electrical continuity.

16. The apparatus of claim 15 wherein the second line input and the second end of the autotransformer and the hot ballast line input are not grounded and are not wired as a neutral.

17. The apparatus of claim 15 wherein the first line input and the second line input provide three phase electrical power that is directly connectable to the lighting apparatus via the autotransformer.

18. The apparatus of claim 15 wherein the apparatus is installed in a facility, and the ballast further comprises a ballast ground connectable to a facility ground and a varistor coupled to the ballast ground.

19. The apparatus of claim 15 wherein the autotransformer is a toroidal step-down transformer.

20. A method of wiring a fluorescent lighting apparatus having a step-down transformer and a ballast, comprising the steps of:

connecting a primary winding of the step-down transformer to a first line input and a second line input;

connecting a secondary winding of the step-down transformer to a common ballast line input and a hot ballast line input of the ballast;

connecting a jumper between one end of the primary winding and one end of the secondary winding so that the second line input and the one end of the primary winding and the one end of the secondary winding and the hot ballast input line have electrical continuity; and connecting a ballast ground of the ballast to a ground.

21. The method of claim 20 wherein the step-down transformer comprises a 480V to 277V step-down transformer, and the step of connecting the jumper between the primary winding of the 480V to 277V step-down transformer provides a voltage between the common ballast input line and the ballast ground of approximately 140-142VAC.

22. The method of claim 21 further comprising the step of supporting the 480V to 277V step-down transformer on the fluorescent lighting apparatus.

23. A method of wiring a fluorescent lighting apparatus having a step-down autotransformer and a ballast, comprising the steps of:

connecting a winding of the step-down autotransformer to a first line input and a second line input;

connecting a tap of the step-down autotransformer to a common ballast line input of the ballast;

connecting a jumper between one end of the winding and a hot ballast line input of the ballast so that the second line input and the one end of the winding and the hot ballast line input have electrical continuity; and connecting a ballast ground of the ballast to a ground.

24. The method of claim 23 further comprising the step of supporting the step-down autotransformer on the fluorescent lighting apparatus.

25. The method of claim 23 wherein the second line input and the one end of the winding of the step-down autotransformer and the hot ballast line input are not grounded and are not wired as a neutral.

* * * * *